US005588643A

United States Patent [19]

Tagliaferri et al.

[11] Patent Number: 5,588,643

[45] Date of Patent: Dec. 31, 1996

[54] METHOD AND DEVICE FOR WITHDRAWING FLAT FOLDED CARTON BLANKS FROM A MAGAZINE AND FOR FEEDING THEM TO A CARTON SET UP LINE

[75] Inventors: Roberto Tagliaferri, Castel S. Pietro; Rodolfo Caroli, Imola, both of Italy

[73] Assignee: I.M.A. Industria Macchine Automatiche S.p.A., Ozzano Emilia, Italy

[21] Appl. No.: 383,634

[22] Filed: Feb. 6, 1995

[30] Foreign Application Priority Data

Feb. 8, 1994 [IT] Italy ..... BO94A0049

[51] Int. Cl.[6] ..... B65H 3/04

[52] U.S. Cl. ..... 271/35; 271/10.07

[58] Field of Search ..... 271/35, 10.06, 271/10.07, 121, 124, 150, 157, 162, 166, 167, 171; 493/318, 319, 120, 122, 147; 414/795.8, 797.4, 797.5, 797.6, 797.9

[56] References Cited

U.S. PATENT DOCUMENTS

| | | | |
|---|---|---|---|
| 2,769,376 | 11/1956 | Chidsey, Jr. et al. . | |
| 4,232,859 | 11/1980 | Tokuno | 271/35 |
| 4,344,611 | 8/1982 | Morita . | |
| 4,395,177 | 7/1983 | Seragnoli | 414/797.6 |
| 4,685,275 | 8/1987 | Nigrelli, Sr. . | |

FOREIGN PATENT DOCUMENTS

| | | | |
|---|---|---|---|
| 1564866 | 4/1969 | France | 271/35 |
| 2129969 | 12/1972 | Germany . | |
| 54-49764 | 4/1979 | Japan | 271/35 |
| 0959409 | 6/1964 | United Kingdom . | |

*Primary Examiner*—David H. Bollinger
*Attorney, Agent, or Firm*—McAulay Fisher Nissen Goldberg & Kiel

[57] ABSTRACT

Tubular blanks, from which containers to be filled and closed are set up, are stacked in flat condition inside a magazine (3), so that they rest on supporting bars. A back edge of the lowermost blank of the stack is engaged by a pair of lugs mounted on a belt conveyor situated under the magazine, so that the lugs protrude upwards beyond a rest plane defined by the supporting bars. The lowermost blank is stripped by passing it through a passage delimited by the supporting bars and stops situated above the supporting bars, and aimed at stopping blanks of the stack situated above the blank just withdrawn. The belt conveyor carries the withdrawn blank through following working stations.

14 Claims, 10 Drawing Sheets

16b
10

2
8
10
18
28
16b
K
27
21
24
25
20
22
19
23
26
2
VII
VII
16a
26a
17
8
18
H

FIG. 7a
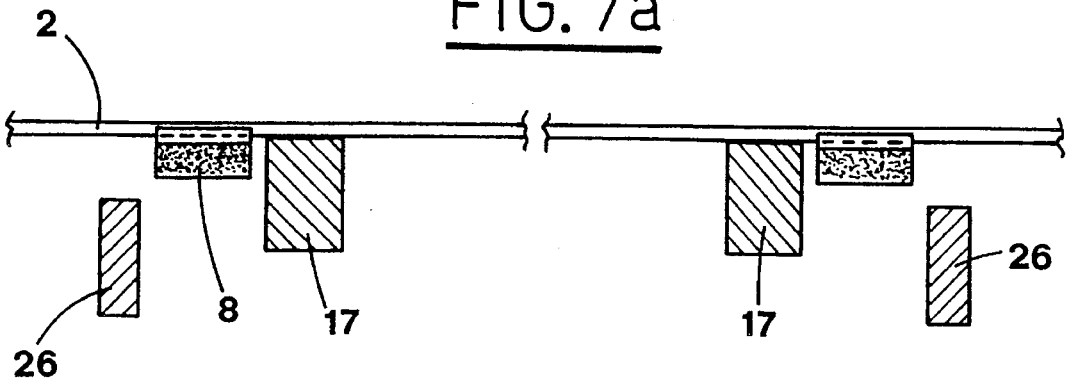
FIG. 7b
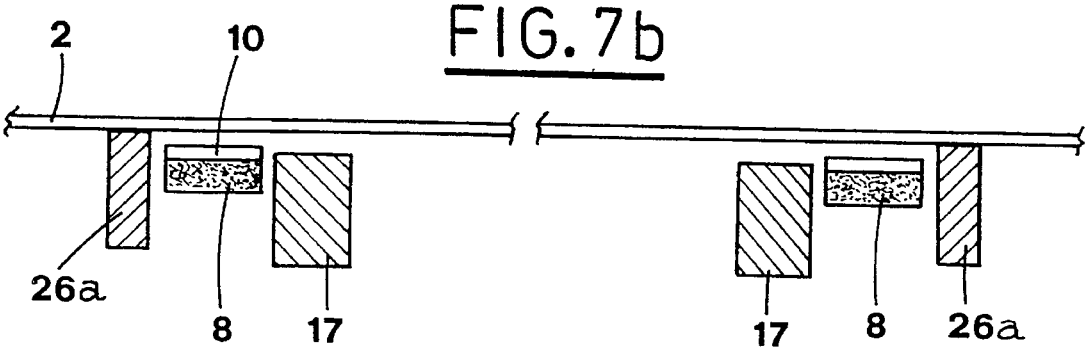
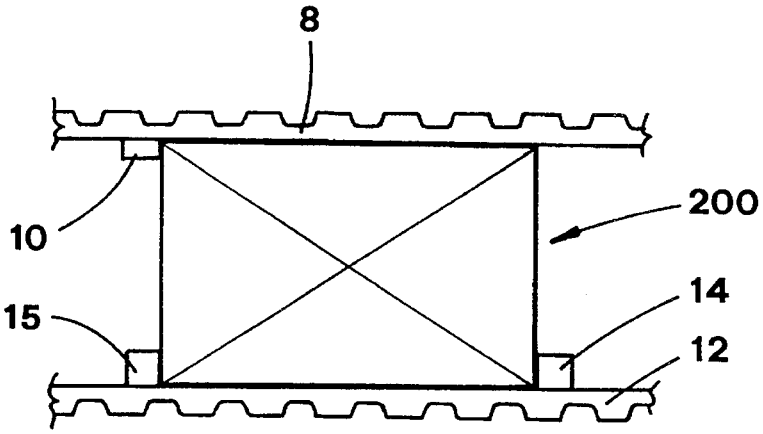
FIG. 10

METHOD AND DEVICE FOR WITHDRAWING FLAT FOLDED CARTON BLANKS FROM A MAGAZINE AND FOR FEEDING THEM TO A CARTON SET UP LINE

BACKGROUND OF THE INVENTION

The present invention relates to withdrawing container blanks stored in a flat folded condition in a magazine, and feeding the blanks to a carton set up line.

DESCRIPTION OF THE PRIOR ART

It is known, in the packaging of various products, to use box-shaped cartons obtained from semistiff material blanks, e.g. of cardboard.

Generally, these blanks are stored in flat folded condition in a suitable magazine, from which they are removed in sequence to be opened and transferred to the product packaging line.

To remove the blanks from the magazine and to feed them to the erecting line, various devices are currently used which generally include special withdrawing means, e.g. suction cups, aimed at removing the blanks from the magazine and at transferring them, one by one, to a conveying line that carries them through the following working stations.

In particular, vertical magazines are currently widely used, which are equipped with precisely sized means which support a stack of blanks thereabove and allow only a single blank to be stripped by elastic deformation thereof.

However, this system causes a major problem when the size of the blanks must be changed in order to pack products with different features and/or dimension.

In such case, not only the width of the magazine must be adjusted, but also the position of the stack supporting means must be precisely set. This operation is generally complicated and requires experts to be carried out, since also the type of material, from which the blanks are obtained, must be considered, in particular its basic weight and stiffness.

To overcome this difficulty, sometimes, it is preferred to replace the whole magazine, which obviously increases the cost of the packaging operation.

Moreover, the blanks may be damaged, while being withdrawn, by the same stack supporting means.

This is a big disadvantage, in particular in fields that require attractive packages, e.g. cosmetics and the like.

SUMMARY OF THE INVENTION

The object of the present invention is to propose a method of withdrawing blanks from the magazine and feeding them to the carton erecting line, that allows to simplify the blank size change over.

Another object of the present invention is to provide a device for withdrawing and feeding the blanks, that is simple, easy and quick to be adjusted, and that facilitates a printing operation on the flat folded blanks.

Yet a further object of the present invention is to provide a device that is capable of withdrawing the blanks without damaging them.

The above mentioned objects are achieved by a method for withdrawing flat folded carton blanks from a magazine where the carton blanks are stored in flat folded condition to form a stack, and for feeding the carton blanks to a feeding line, including:

supporting the stack of flat folded tubular carton blanks by means of a pair of supporting bars;

engaging the rear edge of a lowermost blank of the stack by lugs bound to belt conveyor means situated below the magazine, the lugs protruding upwardly beyond a resting plane defined by the supporting bars;

stripping the lowermost blank by passing it through an opening delimited by the supporting bars and by stop means located thereabove, the stop means stopping blanks situated over the lowermost blank;

conveying the lowermost blank, just withdrawn, through subsequent working stations while being held on the belt conveyor means in abutment against the lugs.

The above method is carried out by a device for withdrawing flat folded carton blanks from a magazine where the carton blanks are stored in flat folded condition to form a stack, and for feeding the carton blanks to a feeding line, the device including:

supporting bars located under the magazine for supporting the stack of flat folded tubular carton blanks;

stop means located downstream of the magazine and over the supporting bars, the stop means cooperating with the supporting bars to delimit an opening having height equal to the thickness of a folded carton blank;

belt conveyor means situated under the magazine and featuring a plurality of lugs regularly spaced apart and protruding upwardly beyond the supporting bars, the lugs engaging a rear edge of a lowermost carton blank of the stack stripping the lowermost blank and conducting it through the opening delimited by the supporting bars and the stop means situated thereabove.

BRIEF DESCRIPTION OF THE DRAWINGS

The characteristic features of the present invention are pointed out in the following with reference to the enclosed drawings, in which:

FIGS. 7*a* and 7*b* show respectively a schematic sectional view taken along the plane VII—VII of FIG. 5, in different operative configurations;

FIG. 10 shows an enlarged view of detail P of FIG. 1;

DESCRIPTION OF TEE PREFERRED EMBODIMENT

Figure 1:
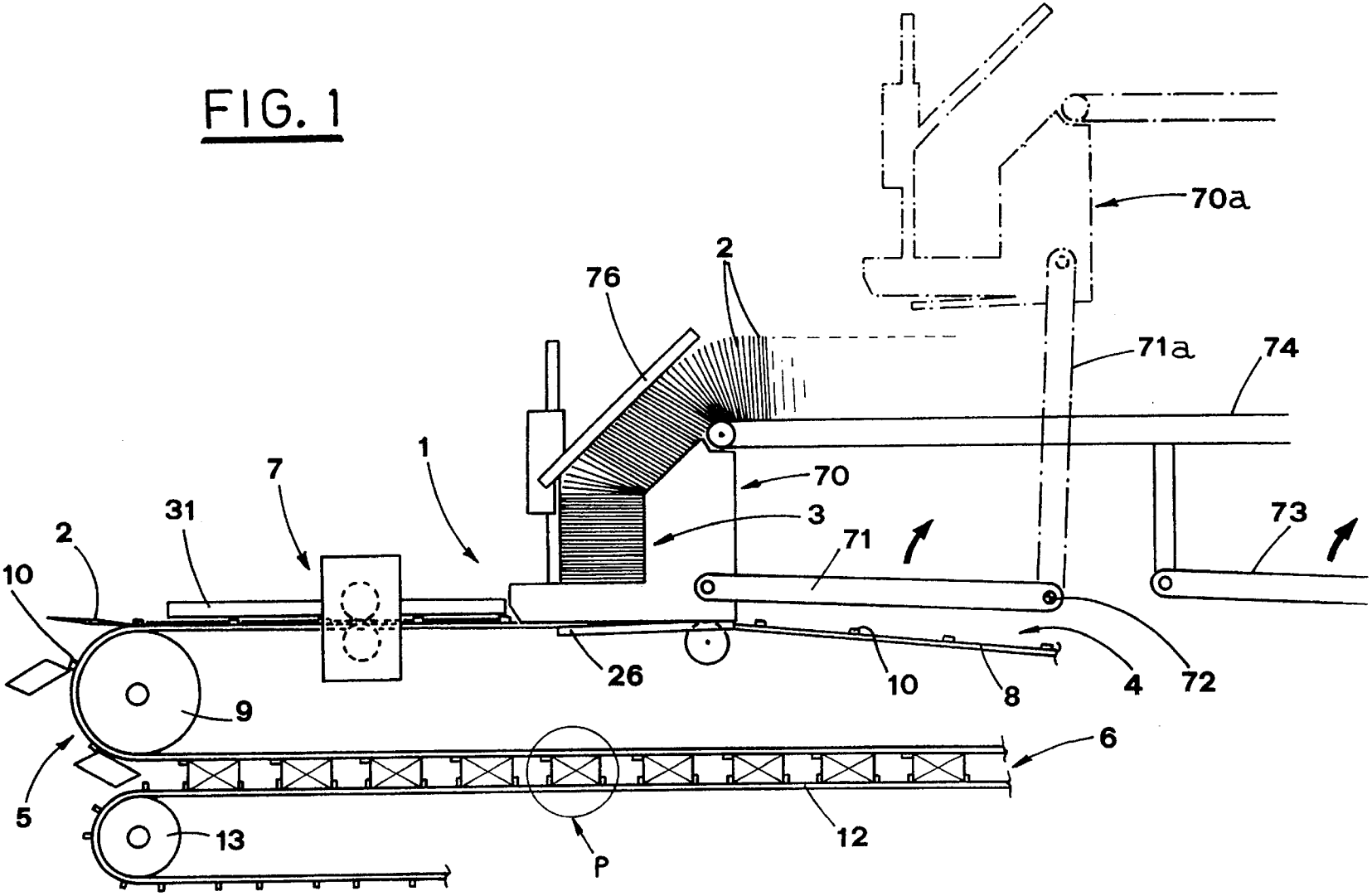
FIG. 1 shows an overall side view of the device that carries out the subject method.
Figure 2:
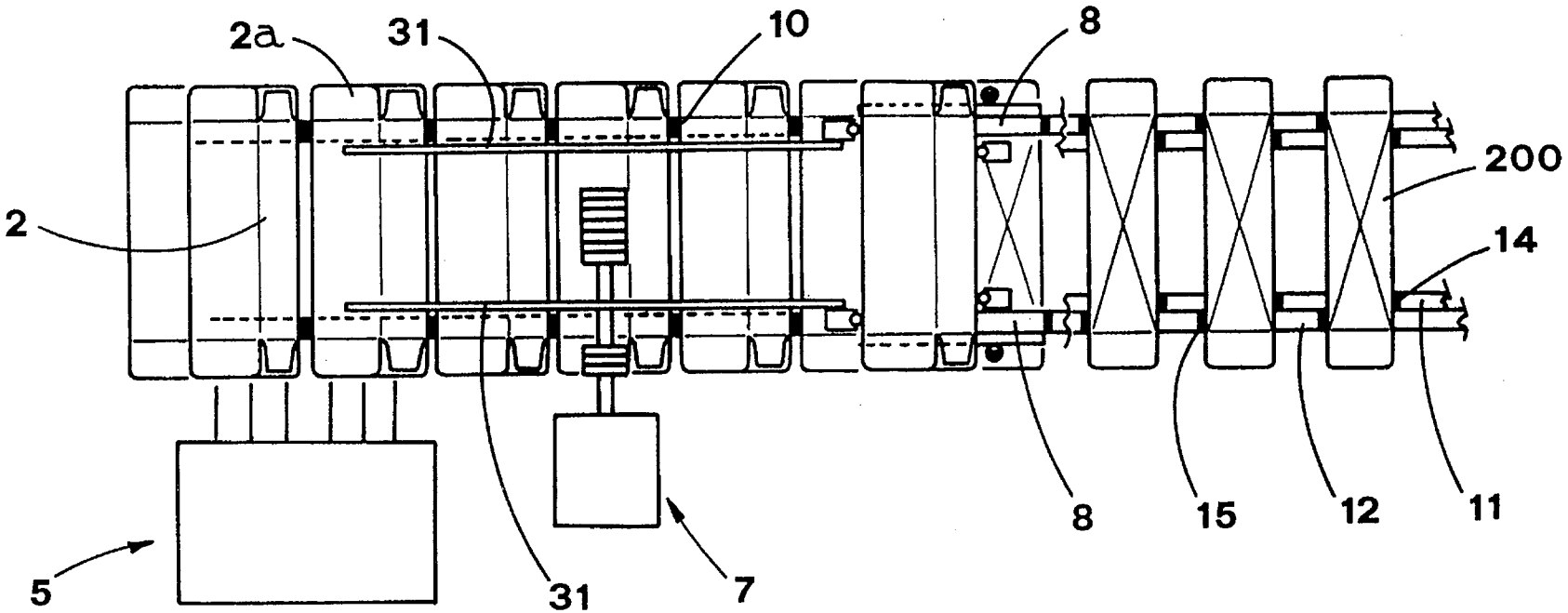
FIG. 2 shows a fragmentary plan view of the device.

Referring now to the drawings, reference numeral 1 indicates a withdrawal station of the device that removes and feeds in sequence the tubular blanks 2, stacked in flat folded condition in a magazine 3.

The withdrawal station 1 is situated along a line 4 feeding the blanks 2 to a device 5 that sets up cartons from the same blanks 2; the setup device 5 is not shown, since it is not part of the present invention.

The set up cartons are moved to a packaging line 6 situated below the feeding line 4 and parallel thereto. Known means 7 for printing messages on the blanks 2, are placed along the feeding line 4, downstream of the withdrawal station 1.

The feeding line 4 includes a pair of toothed belts 8, arranged side by side and trained around a pair of pulleys 9 situated in correspondence with the setup device 5.

On their outer surface, the toothed belts 8 feature a plurality of equidistant lugs 10, aimed at withdrawing and trailing the flat blanks 2.

The packaging line 6 includes a pair of double toothed belts 11, 12 that are trained around coaxial pulleys 13.

Also the belts 11, 12 have, on their outer surface, a plurality of equispaced lugs 14, 15, designed to act as fore and rear stops for the cartons already set up which are conveyed along the line 6, indicated with 200 for the sake of clarity.

More precisely, the lugs 15 of the outermost belts 12, with reference to the line 6, act as a rear stop, while the lugs 14 of the innermost belts 11 act as a fore stop for the cartons 200.

Therefore, the distance between these couples of lugs 14, 15 defines the holding space for each carton to be packaged.

It is possible to change this distance, according to different cartons sizes, by changing the reciprocal angular position of the pulleys 13 of the belts 11 with respect to those of the belts 12.

It is also possible to change the distance between the two pairs of belts 11, 12, in relation to the cartons longitudinal size, by moving axially a pair of pulleys 13.

Likewise, the distance between the belts 8 of the feeding line 4 can be changed by changing the distance between the respective pulleys 9.

The lower runs of the belts 8 cooperate with the belts 11, 12 of the packaging line 6, so as to retain the cartons 2 at the top.

Actually, the two pairs of lugs 10, 15 push the back of the cartons as trailing means, while the pair of fore lugs 14 retain the carton in the set up condition, preventing it from partial folding due to the material elasticity.

As seen in the particular P shown enlarged in FIG. 10, the lugs 10 of the belts 8 are considerably lower than the teeth 14, 15 of the belts 11, 12 so as to facilitate opening of the blanks 2 as well as withdrawing of the same blanks.

The magazine 3 is supported by a frame structure 70 that is linked to a couple of arms 71 which can oscillate around a pin 72 with respect to the support structure of the device.

Moreover, the frame structure 70 is linked to a pair of driving arms 73 that, together with the above mentioned arms 71, form a hinge linked parallelogram.

Therefore, activation of the arms 73 causes correspondent rotation of the arms 71 that move to the position indicated with the sketched line **71*a* in FIG. 1. Consequently the frame that supports the magazine 3, is shifted to the raised position 70*a*. In its upper part, the frame 70 carries a belt conveyor 74 that feeds the magazine 3 with the blanks 2**.

The magazine 3 has vertical guides **16*a*, 16*b*, respectively fore and rear with respect to the moving direction of the feeding line 4, aimed at guiding the stack of blanks 2**.

As will be explained in the following, these guides are movable so as to adjust the dimensions of the magazine 3 in accordance with different sizes of the blanks 2 used to set up the cartons.

Figure 3:
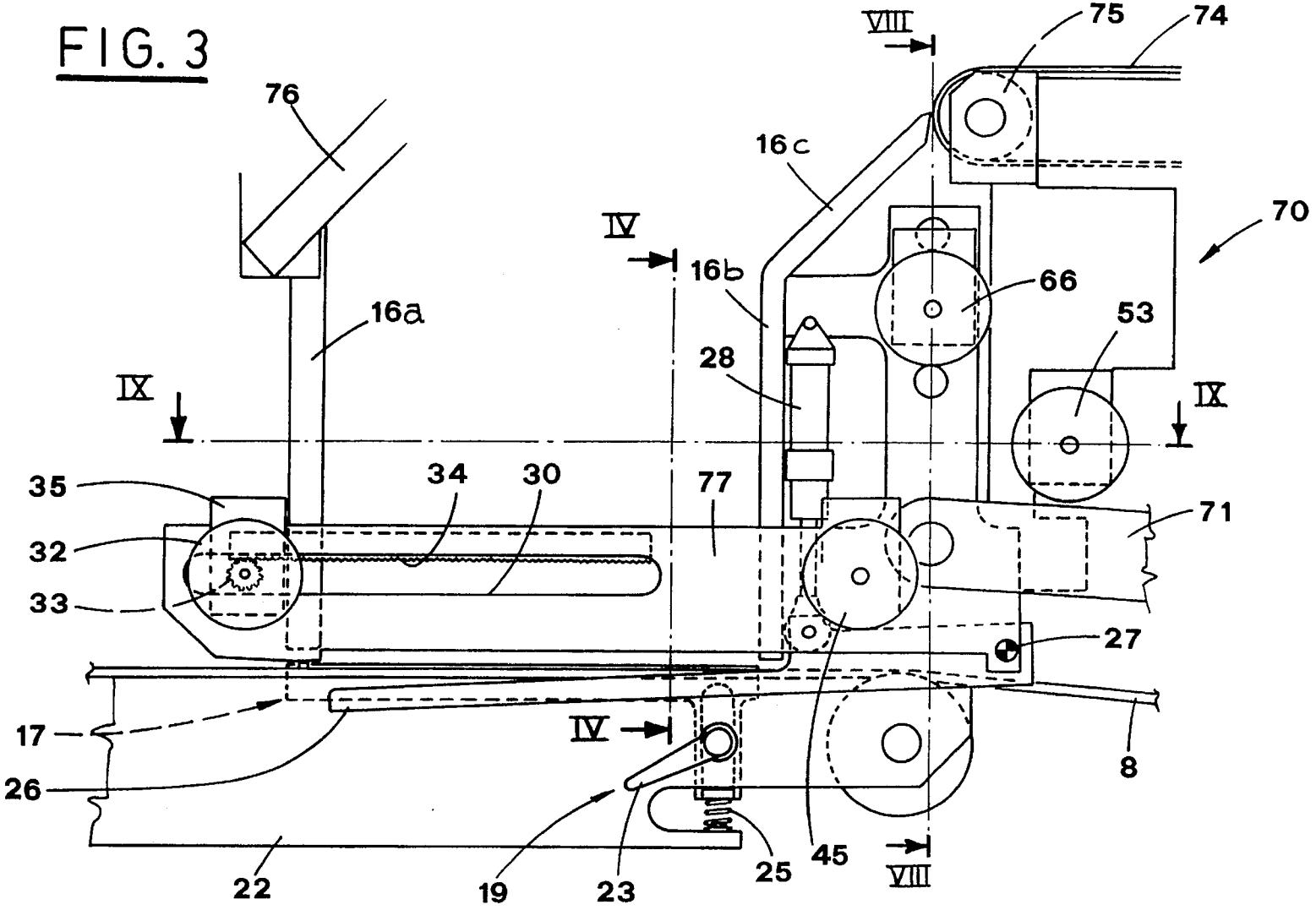
FIG. 3 shows a side view of the blank withdrawal station.

The upper guide sections **16*c* of the rear guides 16*b* are inclined and extend close to the feed belt conveyor 74 (see FIG. 3**).

The inclined guide sections **16*c* are in fact tangential to the pulley 75, on which the belt conveyor 74** turns around.

In front of the inclined guide sections **16*c* there is located a guiding member 76, aimed at guiding the blanks 2. It is possible to adjust the position of the guiding member 76** according to the size of the blanks.

Two bars 17 are-placed below the magazine 3, parallel to the belts 8, and the stack of blanks 2 rests on the upper surfaces of the bars.

The resting plane, defined by the upper surface of the bars 17, is slightly higher than the conveying plane formed by the belts 8, but lower than the top of the lugs 10.

Figures 5, 5A, 5B:
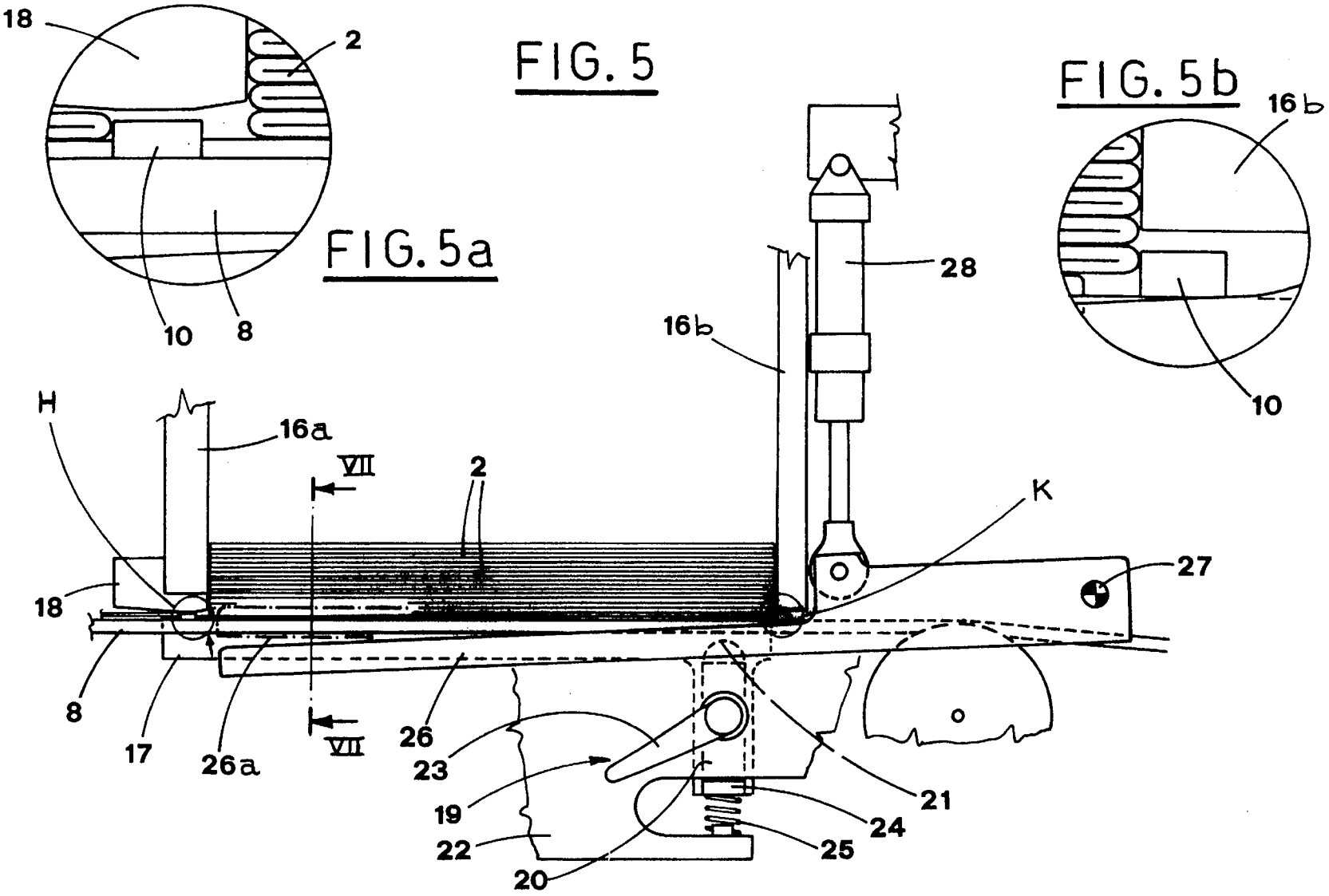
FIG. 5 shows a detailed side view of the above mentioned blank withdrawal station.
FIG. 5*a* is an enlarged view of a detail indicated by H in FIG. 5.
FIG. 5*b* is an enlarged view of a detail indicated by K in FIG. 5.

Stop means 18, situated downstream of the magazine 3 and vertically adjustable, cooperate with the supporting bars 17 (see FIG. 5).

The vertical position of the bars 17 is adjustable by a special adjusting element 19, operated manually.

This adjusting element 19 includes a slide 20 sliding in a correspondent vertical slot 21 made in the lower prominence of each bar 17; the slide 20 can be locked to a correspondent wall 22, bound to the support frame, by means of a locking lever 23.

It is to be pointed out that, in its upper part, the wall 22 supports and guides a respective toothed belt 8, in its section underlying the withdrawal station 1.

In its lower part, the slide 20 features a plate 24, on which a helical spring 25 acts, along the same vertical axis.

Between the supporting bars 17 and the stop means 18, there is formed a passage S, as wide as the passage between the plate 24 and the lower edge of the wall 22, and substantially equal to the thickness of a flattened blank 2, when the device is set into operation (see FIG. **6*b***).

Figure 6B:
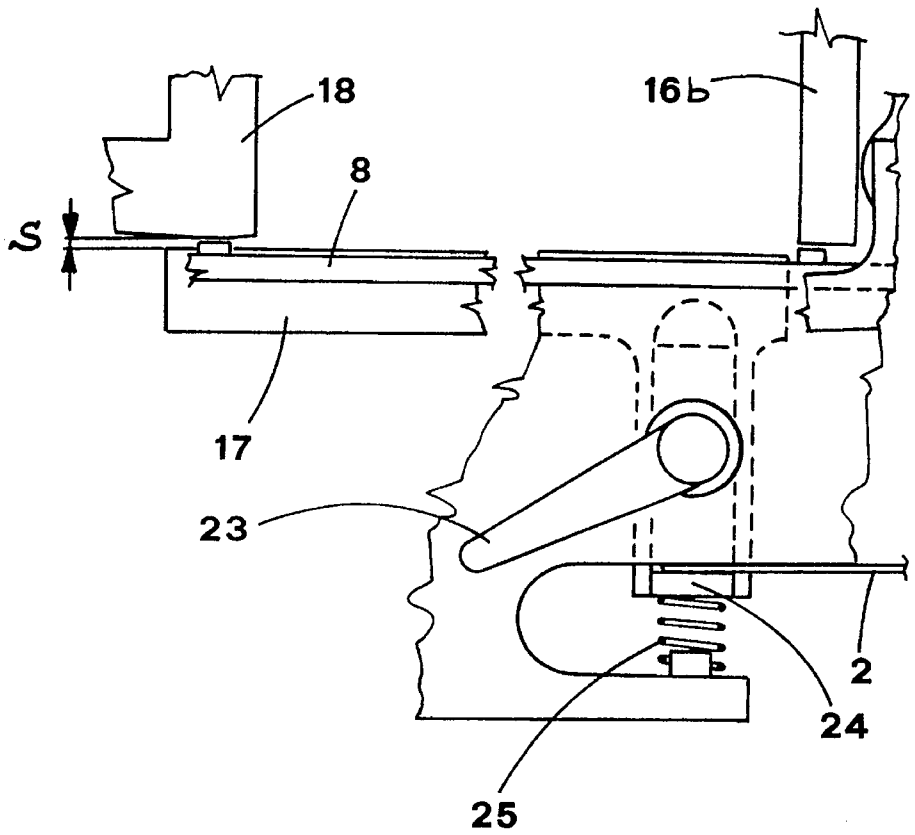
FIGS. 6*a* and 6*b* show a detail of the withdrawal station shown in FIG. 5, in adjustment and in use configurations respectively.
Figure 6A:
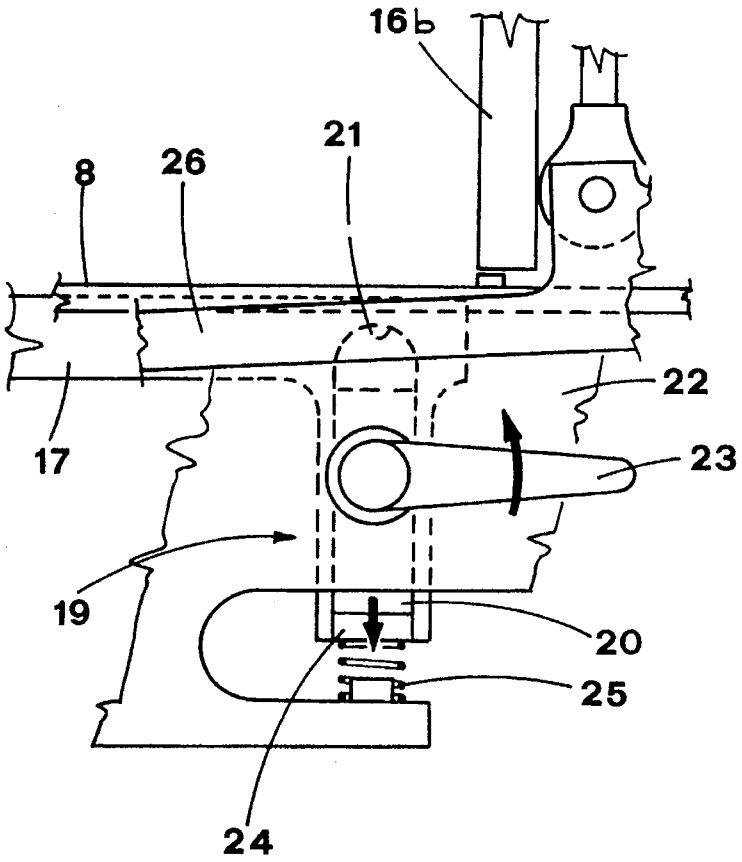

The width of the passage S can be adjusted in relation to the blank 2 thickness, by unlocking the locking lever 23 and moving downward the slide 20, against the spring 25, as seen in FIG. **6*b*. To carry out the adjustment of the passage S, a blank 2 is introduced between the plate 24 and the lower edge of the wall 22, in such a manner to elastically clasp the blank, and the slide it then locked in this position (see FIG. 6*b***).

The stop means 18 can be mounted with a possibility of oscillation and subject to related elastic means, so as to prevent the blanks from jamming during withdrawal and to facilitate release thereof.

Two rockers 26, arranged side by side, are pivoted to the frame 70 by means of a pin 27 transversal to the feeding line 4. The rockers 26 extend under the magazine 3 and can oscillate.

Jacks 28, bound to the frame 70, make the rockers 26 move between a lowered position, in which the device operates in normal condition, and a raised position, that is shown partially by the sketched line 26*a* in FIG. 5.

When they are in the lowered position, the rockers 26 do not interfere with the belts 8 that withdraw and convey-the blanks (see FIG. 7*a*).

In the raised position 26*a*, the rockers raise the stack of blanks 2 inside the magazine 3 preventing the blanks from being withdrawn by the belts 8 (see FIG. 7*b*).

Accordingly, the method of the present invention indicates that the bars 17 support the stack of tubular blanks 2 placed in flattened condition in the magazine 3 and destined to form cartons 200 to be packaged.

Below the blanks stack, there are the belts 8, with the lugs 10 protruding upward beyond the resting plane defined by the upper surfaces of the bars 17.

Therefore, passing below the magazine 3, each pair of lugs 10 engages the rear edge of the lowermost blank 2.

The blank 2 is withdrawn from the magazine 3 since it can pass through the passage defined by the supporting bars 17 and the stop means 18.

The upper blanks of the stack are prevented from being withdrawn from the magazine 3 by the stop means 18 that hold them at the fore edge, as clearly seen in FIG. 5.

After leaving the magazine 3, no more supported by the bars 17, the blank 2 lays down on the belts 8, whose conveying surface is slightly lower than the resting surface of the bars 17.

In practice, the withdrawn blank 2 is housed in the space defined between two subsequent pairs of lugs 10 and is stopped by rear pair of lugs 10.

It is to be pointed out that the lugs 10 of the belts 8 not only withdraw the blanks 2 from the magazine 3 but also trail the set up cartons 200 along the packaging line 6, while cooperating with the lugs 14, 15 of the belts 11, 12, so as to maintain the correct set up position of the cartons 200.

The lugs 10 of the belts 8 cooperate with the lugs 14 of the belts 12 in trailing the cartons 200.

If the blank size is to be changed, it is possible to adjust the magazine 3 size by suitably changing the position of the angular guides 16*a*, 16*b*.

Figure 9:
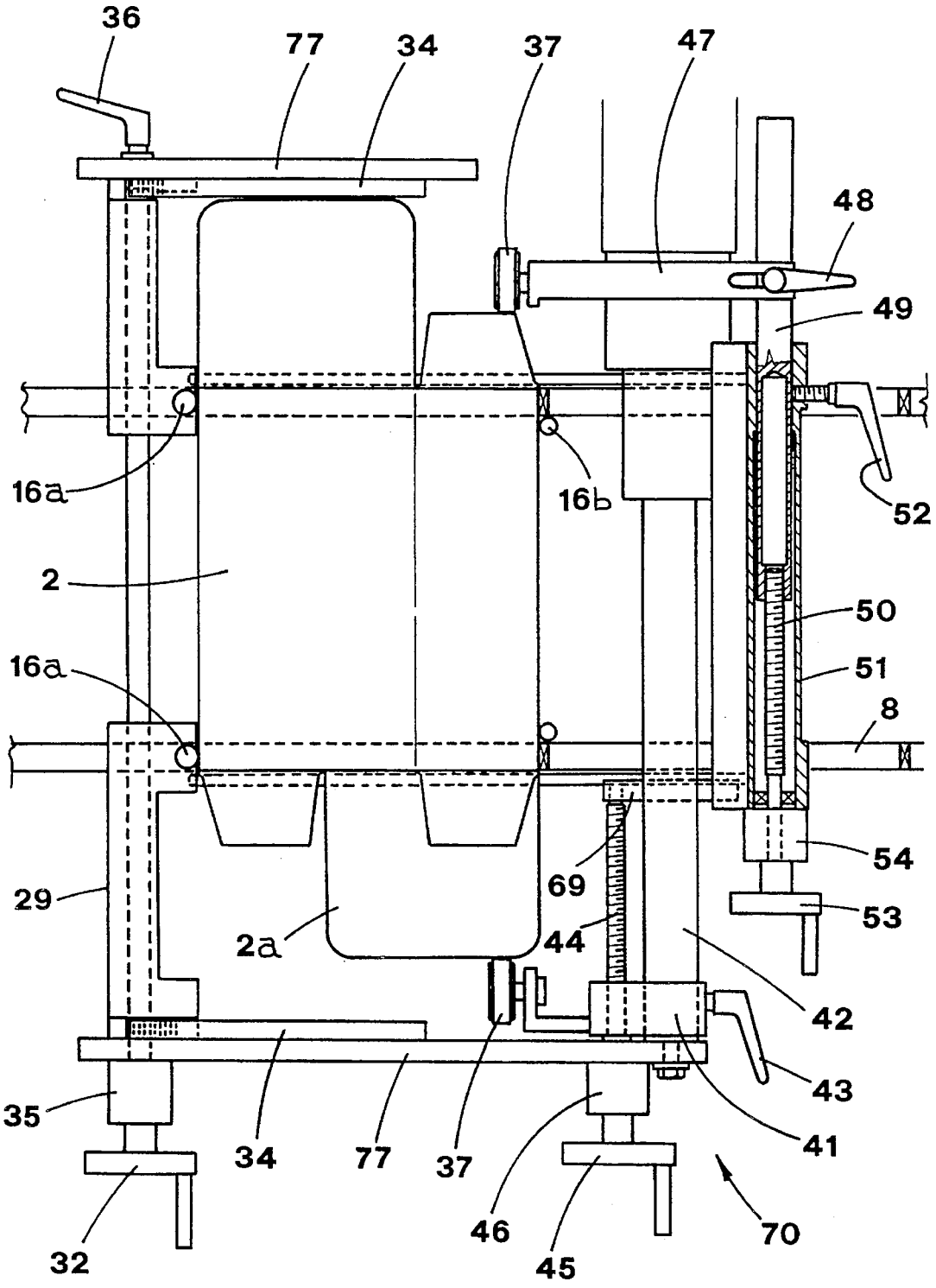
FIG. 9 shows a sectional view taken along the plane IX—IX of FIG. 3.

In order to make possible changing the magazine 3 longitudinal dimension, the fore guides 16*a* are supported by a carriage 29 (FIG. 9), that moves along the feeding line 4 through suitable slotted guides 30 made in correspondent sides 77 of the frame 70 that supports the magazine 3 (see FIGS. 3 and 9).

The carriage 29 also supports the stop means 18 as well as another pair of stop means 31 (see FIG. 1), aimed at acting on the blanks 2 from the top, downstream of the withdrawal station 1; preferably, the stop means 31 are formed by special brushes.

The carriage 29 is operated by a handwheel 32 that controls rotation of a sprocket gear 33 having horizontal axis and crossing the feeding line 4 from side to side.

On its ends, the sprocket gear 33 is in meshing engagement with a couple of racks 34 longitudinal to the feeding line 4 and integral with the supporting frame structure.

A suitable digital indicator 35 is connected with the handwheel 32 so that it is possible to check the displacement of the carriage 29, and consequently the adjustment position.

The carriage 29 can be locked manually by means of a locking lever 36. In order to change the transversal dimension of the magazine 3, at least one of the guides 16*a*, 16*b* is moved transversally to the line 4, so as to change the distance between the same line and the symmetrical guides.

Obviously, it is necessary to move at the same time also the group supporting the belt 8 and providing adjustment for the means associated thereto.

Figures 8, 8A:
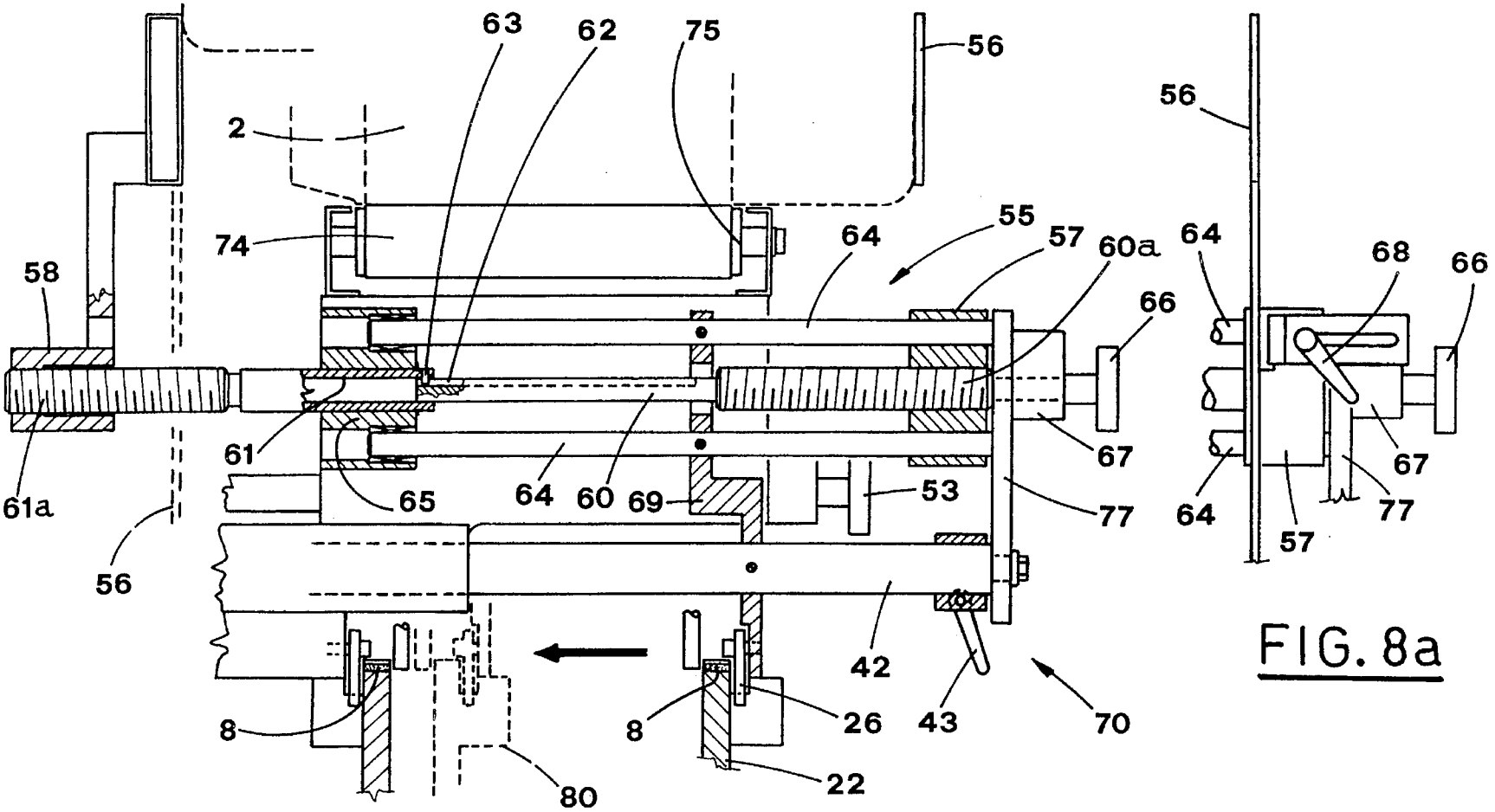
FIG. 8 shows a sectional view taken along the plane VIII—VIII of FIG. 3.
FIG. 8*a* shows a sectional view of a detail of FIG. 8 as it appears.

In FIG. 8 the broken line 80 indicates the position of the minimum reciprocal distance assumed by the above mentioned groups.

These movements are operated by centralised means, not shown in the drawing.

The magazine 3 is equipped also with a pair of vertical belts 37, situated on the opposite sides of the feeding line 4 and facing each other.

The belts 37 are designed to hold the side flaps 2*a* of the blanks 2.

The belts 37 are trained around respective pairs of pulleys 38 and are driven by a gearmotor 39, so as to push downward the edges of the side flaps 2*a* until they touch a rest plane 40.

Figure 4:
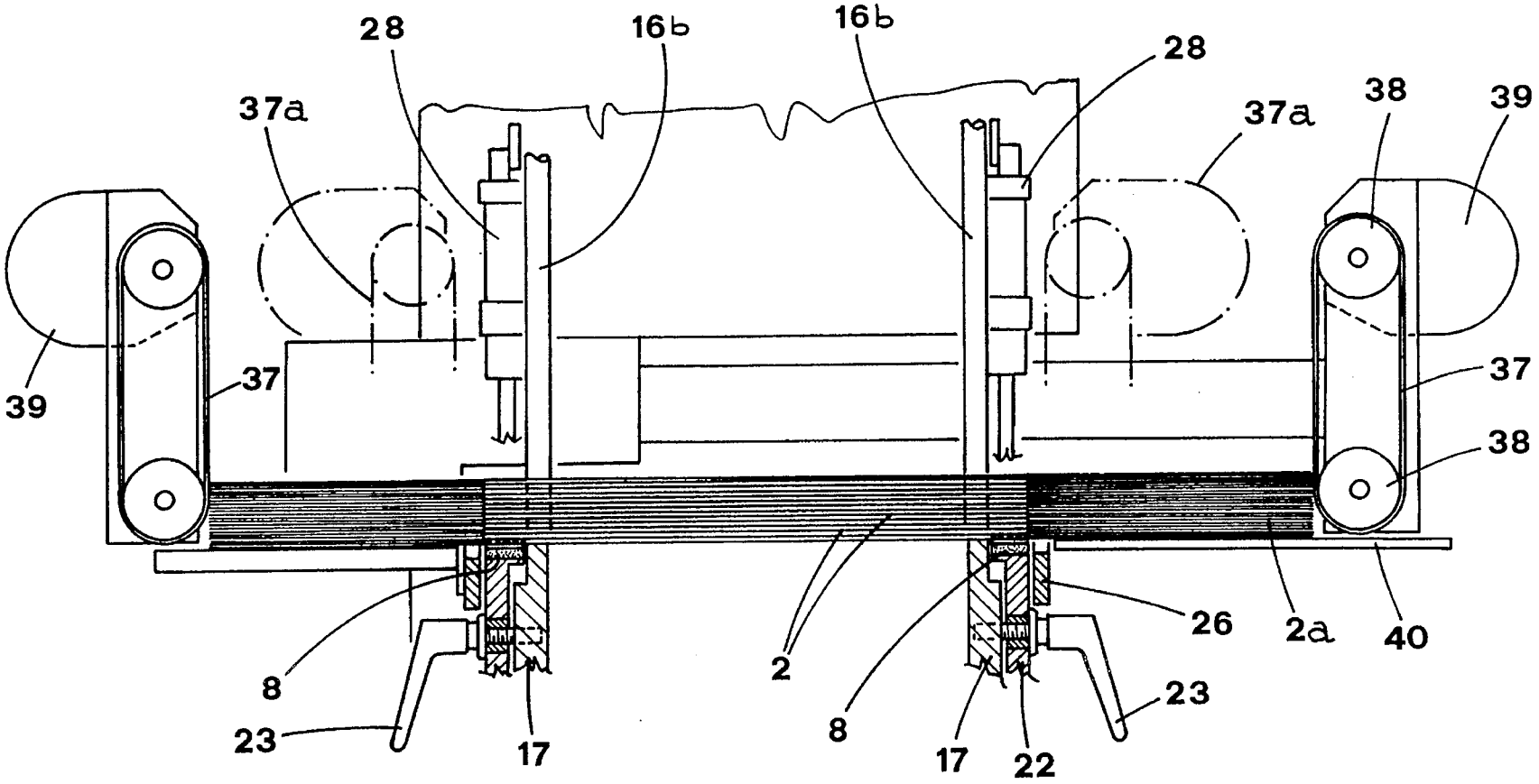
FIG. 4 shows a cross sectional view taken along the plane IV—IV of FIG. 3.

It is possible to adjust the belts 37 transversally to the line 4, independently from the guides 16*a*, 16*b* and from each other, in accordance with the blanks 2 size, as indicated with the broken line 37*a* in FIG. 4.

In order to allow adjustment of the belts 37, the first of them is supported by a slide block 41, mounted slidably on a horizontal shaft 42 carried by the frame 70 and transversal to the feeding line 4.

The slide block 41 can be locked manually by means of a respective locking lever 43.

The slide block 41 movements are controlled by a threaded shaft 44 that can be driven to rotate about an axis parallel to the shaft 42, by a handwheel 45 connected with a special digital indicator 46 aimed at allowing check of the adjustment position.

The threaded shaft 44 is in meshing engagement with a correspondent female thread made in the slide block 41.

The second belt 37 is carried by a support 47 that can be locked to a tubular shaft 49 by means of a related locking means 48. The tubular shaft 49 features an internal threaded portion with which a threaded shaft 50 is engaged.

The threaded shaft 50 rotates in coaxial relation with a sleeve 51 inside which the same shaft 49 is inserted.

The shaft 49 can be locked to the sleeve 51 by means of another locking lever 52. The screw shaft 50 can be rotated by a handwheel 53 connected with a relative digital indicator 54.

The position of the slide block 41 and the shaft 49, that support the belts 37, can be changed by operating the handwheels 45, 53.

At the back of the magazine 3, there is a group 55 aimed at adjusting symmetrically the position of a pair of vertical side walls 56 extending in the upper part of the magazine and having the task of containing the blanks 2 (see FIGS. 8 and 8*a*).

The walls 56 are supported by respective sliding blocks 57, 58 that features respective internal threads which are in screw engagement with threaded portions 60*a*, 61*a* respectively made on a shaft 60 and on a tubular shaft 61 which are in coaxial relation.

The shaft 60 is inserted telescopically inside the tubular shaft 61 and has a longitudinal groove 62 engaged by a pin 63 fixed to the same tubular shaft 61, so as to maintain mutual connection during rotation.

The slide block 57 is slidably set on a pair of rods 64 bound to the frame 70 and sliding axially with respect to a bushing 65 that is set between the frame 70 and the tubular shaft 61 that is in this way rotatingly supported.

The telescopical shafts 60, 61 can be rotated by a handwheel 66 connected to a suitable digital indicator 67, and can be locked by a related locking lever 68.

The mutual position of the slide blocks 57, 58 supporting the side walls 56 can be changed by rotating the handwheel 66.

The shaft 42 and the rods 64 are bound to a plate 69 that is part of the above mentioned group for supporting the belt 8, that can be moved transversally, and adjusting the means associated thereto.

In particular, a rocker 26 is pivoted to the plate 69 for raising the blanks 2 stack inside the magazine 3.

Therefore, transversal movement of the above mentioned group results in a similar movement of the shaft 42 and rods 64, and consequently, of the slide blocks 41, 57 carrying respectively, one of the belts 37 and one of the side walls 56.

The above described method and device permit to withdraw the blanks 2 from the magazine 3 and subsequently feed the same blanks 2 to the packaging line, in the best way.

In fact, the belts 8 equipped with the lugs 10 withdraw the blanks 2 one by one, and then carry them through the following working stations, avoiding intermediate pushing means or the like, as used in the known devices, and a considerable simplification and safety of the packaging operations is thus obtained.

Moreover, correct position of the cartons 200 during the withdrawing step and the subsequent correct feeding to the packaging line 6, are assured.

In particular, the blanks 2 are withdrawn from the magazine 3 in horizontal position that facilitates subsequent printing thereon performed by printing means placed downstream of the same magazine.

Owing to the above described characteristics, the device subject of the present invention operates with high speed, so as to increase productivity and reliability in packaging operation.

It is also to be pointed out that the invention allows the magazine 3 to be rapidly and easily adjusted, so as to receive carton blanks having different sizes and shapes, as required.

Another advantage of the present invention is that the magazine 3 and its adjustment means are supported by a frame structure 70 that can be easily raised relative to the feeding line 4.

This allows the line 4 to be rapidly accessible for possible maintenance or similar operations.

Further advantage of the described device is that it prevents the blanks from being damaged, specially during the withdrawal, as often occurs instead in conventional devices.

FIGS. 11*a*, 11*b*, 11*c* and 11*d* show another embodiment of the subject method, designed particularly to withdraw and feed blanks of size bigger than the one defined by the distance between two subsequent lugs 10 of the belts 8.

According to this solution, the stop means 18 situated downstream of the magazine 3, are mounted on a horizontal pivot 81 transversal to the blank feeding line 4, so that they can oscillate.

This oscillation is elastically opposed by spring means 82 that urge on a support element 83.

Obviously, also in this case, the stop means 18 can be adjusted vertically, by moving the support element 83.

In the lower part, on the side facing the magazine 3, the stop means 18 feature a shoulder 84 as thick as a single blank 2 and having the front edge suitably smoothed.

Figure 11A:
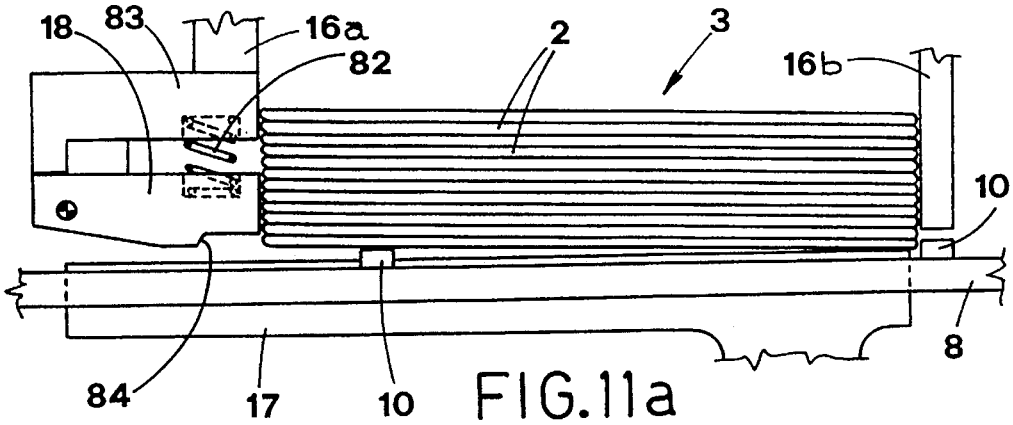
FIGS. 11*a*, 11*b*, 11*c* and 11*d* show detailed side views of a different embodiment of the aforesaid blanks withdrawal station, in various operative steps.

As seen in FIG. 11*a*, at the beginning, the front part of the stack of blanks 2 rests on a pair of lugs 10 of the belts 8 and is slightly inclined upward, considering the feeding line 4 movement; at the back, the stack of blanks 2 rests on the bars 17.

As already said, this situation occurs when the blanks 2 size is bigger than the distance between the lugs 10.

Figure 11B:
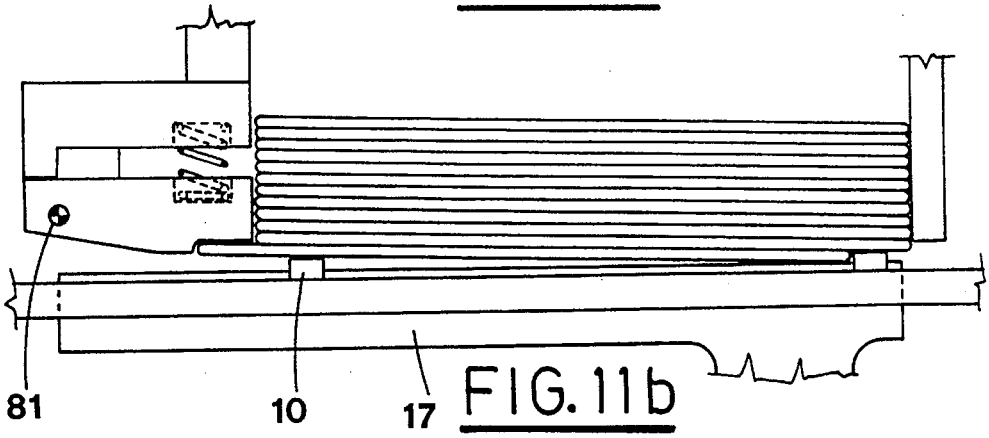

Therefore, when the belts 8 are operated, the pair of lugs 10 placed behind the lugs supporting the stack of blanks, engage the back edge of the lowermost blank 2, withdrawing it from the magazine 3 (FIG. 11*b*).

At this point, the withdrawn blank passes through the passage defined by the shoulder 84 of the stop means 18.

The upper blanks of the stack are prevented from withdrawing from the magazine 3 by the stop means 18 that hold them at the front, as clearly seen in FIG. 11*b*.

Figure 11C:
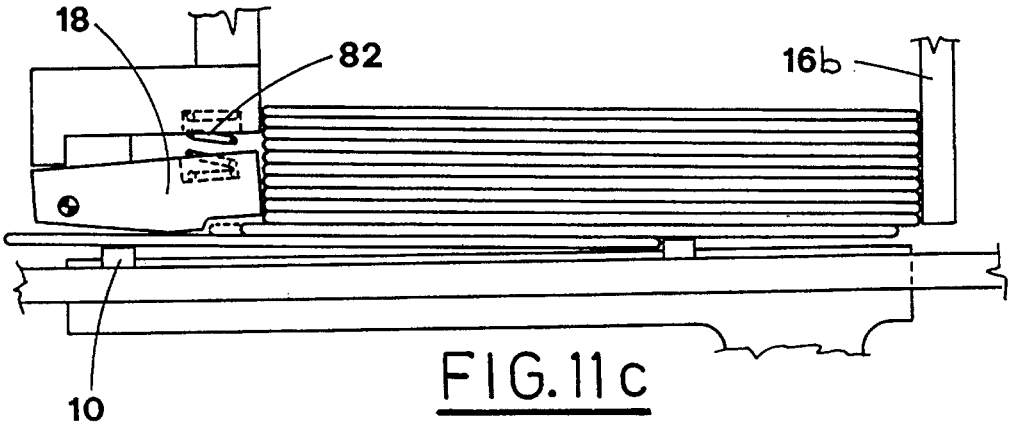

When the withdrawn blank reaches the shoulder 84 it makes the stop means 18 rotate upwards about the pivot 81 by acting on the shoulder smoothed edge and overcoming the elastic reaction of the spring means 82, so as to pass below the stop means 18 (FIG. 11*c*).

At the same time, the blank right over the one just withdrawn is trailed in the line movement direction, because of mutual friction between the blanks, and engages, with the front edge, the shoulder 84 of the stop means 18, left free by the previous blank.

Figure 11D:
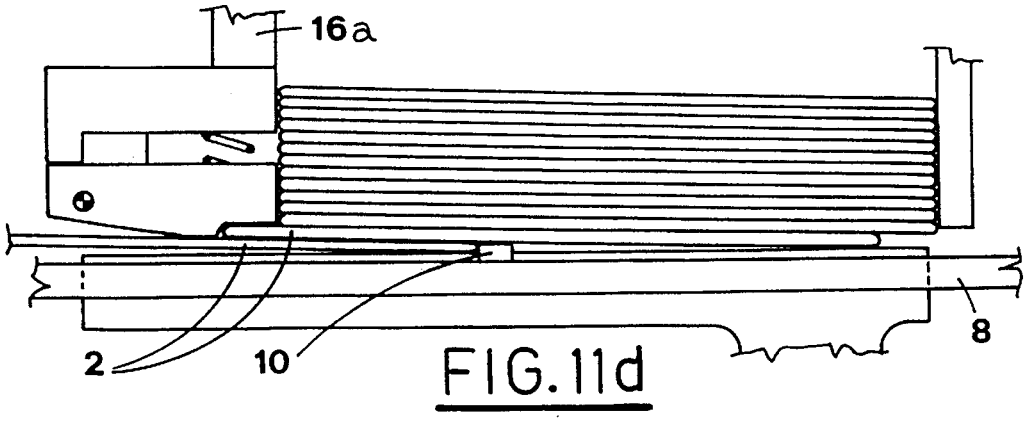

In this way, the second blank is inclined, being supported at back by the bars 17 and engaged at front with the shoulder 84 of the stop means 18 (FIG. 11*d*).

Likewise, in normal operation, other blanks 2 of the stack are withdrawn from the magazine 3.

As described, this solution allows to withdraw the blanks of different sizes, bigger than the distance between the lugs 10 of the belts 8, without replacing the same belts 8, that is advantageous from the point of view of functionality and use versatility.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A device for withdrawing flat folded cannon blanks from a magazine where said carton blanks are stored in a flat folded condition to form a stack, and for feeding said cannon blanks to a feeding line, said device comprising:

supporting bars located under said magazine for supporting said stack of flat folded tubular cannon blanks;

stop means located downstream of said magazine and over said supporting bars, said stop means cooperating with said supporting bars to delimit an opening having a height equal to a thickness of a folded carton blank; and belt conveyor means situated under said magazine and featuring a plurality of lugs regularly spaced apart and protruding upwardly beyond said supporting bars, said lugs engaging a rear edge of a lowermost carton blank of said stack for stripping said lowermost blank and conducting said lowermost blank through said opening delimited by said supporting bars and said stop means situated thereabove;

said magazine including front vertical guides and rear vertical guides, with reference to advancement movements of said belt conveyor means, with at least said front vertical guides supported by a carriage that is slidably supported by a frame forming part of said magazine, and that is moved by rack means, so that said front vertical guides can be moved to adjust longitudinal dimensions of said magazine.

2. A device according to claim 1, wherein said rear vertical guides have upper inclined sections connecting said magazine with a belt conveyor that brings carton blanks to said magazine, guiding means positioned in front of said upper inclined sections for guiding said carton blanks, said guiding means being adjustable in accordance with the size of said blanks.

3. A device according to claim 1, wherein a resting plane defined by upper surfaces of said supporting bars is slightly higher than a conveying plane defined by said belt conveyor means.

4. A device according to claim 1, wherein said supporting bars are fixed to an adjusting member so that they can be moved vertically to adjust a width of said opening, said adjusting member including a slide, guided along a vertical slot made in each supporting bar, and a locking member that locks said slide to a corresponding wall of a stationary support structure, said slide having a plate fixed at bottom and aimed at defining an opening having a width equal to the width of said opening delimited by said supporting bars, when said device is in operation, and aimed at clamping elastically a blank, due to the action of spring means, when said device is adjusted.

5. A device according to claim 1, wherein rocker means are located under said magazine and mounted on an axis fixed to said frame and transversal to said belt conveyor means, said rocker means being made to oscillate by respective jacks between a lowered position, and a raised position in which said rocker means raise said stack of blanks thus preventing said blanks from being withdrawn by said lugs.

6. A device according to claim 1, wherein said magazine includes a pair of sidewise positioned vertical belts for holding lateral flaps of said blanks, said vertical belts being driven by respective gear motor means so that side edges of said lateral flaps are pushed downwards against a rest plane.

7. A device according to claim 1, wherein said vertical belts are fastened to respective supporting means mounted on a frame of said magazine, said supporting means being moved, transversally relative to said belt conveyor means, by threaded shafts, namely a first threaded shaft and a second threaded shaft, which are in screw engagement with internal threads made in said supporting means, so that said vertical belts are adjusted in direction transversal to said belt conveyor means and independently from each other.

8. A device according to claim 1, wherein said magazine includes a pair of side walls for holding said blanks, said side walls being located sidewise at top of said magazine and supported by a frame of said magazine by means of respective sliding blocks, namely a first sliding block and a second sliding block, which are moved transversally relative to said belt conveyor means in opposed direction by a first threaded shaft and a second threaded shaft which are set in screw engagement with internal threads of said sliding blocks and rotated to adjust said side walls transversely relative to said belt conveyor means.

9. A device according to claim 1, wherein said first threaded shaft has a threaded portion situated at one end and in screw engagement with an internal thread of said first sliding block while a remainder end of said first shaft is telescopically inserted into a corresponding end of said second threaded shaft that is tubular and has a respective outer threaded portion arranged in screw engagement with a corresponding internal thread made in the said second sliding block, said second threaded shaft having a transversal pin that runs in a longitudinal groove made in said first threaded shaft.

10. A device according to claim 1, wherein a lower run of said belt conveyor means cooperates with other belt conveyor means provided with respective lugs which hold and push fore and rear ends of a set up carton, while said lower run of said belt conveyor means holds said carton at the top.

11. A device according to claim 1, wherein said stop means are arranged with a horizontal axis transverse to said belt conveyor means so that they can oscillate against related spring means, said stop means further including a shoulder facing downwards and towards said magazine, said shoulder having a height equal to the thickness of a flat folded blank, so that said shoulder is engaged by a lowermost blank (2) of said stack with an escapement effect.

12. A device according to claim 11, wherein said lowermost blank, is inclined inside said magazine with its rear edge supported by said supporting bars and its front edge in engagement with said shoulder of said stop means.

13. A device according to claim 1, wherein said magazine has a frame connected to a plurality of arms, said arms being pivoted to a stationary structure of said machine, so that said arms can be swung in a longitudinal vertical plane to move said magazine to a raised position higher than an underlying feeding line formed by said belt conveyor means.

14. A device according to claim 1, wherein said stop means is supported on said carriage, further comprising guide means on said carriage for guiding said blanks downstream of said magazine.

* * * * *